United States Patent [19]

Bouchard

[11] 4,449,950

[45] May 22, 1984

[54] METHOD OF MAKING PHOTOFLASH LAMP TO PREVENT SHRED MIGRATION INTO TIP PORTION OF LAMP ENVELOPE DURING SEALING THEREOF

[75] Inventor: Andre C. Bouchard, Peabody, Mass.

[73] Assignee: GTE Products Corporation, Stamford, Conn.

[21] Appl. No.: 353,317

[22] Filed: Mar. 1, 1982

[51] Int. Cl.[3] ..... F21K 5/02; H01J 9/40

[52] U.S. Cl. ..... 445/28; 431/360

[58] Field of Search ..... 445/28; 431/360, 362, 431/364, 365

[56] References Cited

U.S. PATENT DOCUMENTS

| | | | |
|---|---|---|---|
| 2,136,234 | 11/1938 | Cartun | 431/362 |
| 3,303,674 | 2/1967 | Anderson | 431/362 |
| 3,630,650 | 12/1971 | Kaufmann | 431/362 |
| 3,823,994 | 7/1974 | De Graaf et al. | 445/28 |
| 4,229,161 | 10/1980 | Bouchard et al. | 431/362 |
| 4,278,310 | 7/1981 | Waymouth et al. | 445/28 |

*Primary Examiner*—Kenneth J. Ramsey
*Attorney, Agent, or Firm*—Lawrence R. Fraley

[57] ABSTRACT

A method of making a photoflash lamp wherein an elongated piece of glass tubing is sealed at a first end thereof to secure a pair of lead-in wires therein. Thereafter, a quantity of primer material is positioned within the tubing through the second, open end thereof and deposited on an internal bottom surface of the tubing. A quantity of shredded combustible material (e.g. zirconium) is then air blown within the tubing member, and thereafter a thin member (mica disk) is frictionally inserted through the open end. The tubing member is then restricted, a combustion-supporting atmosphere (e.g., oxygen) introduced therein, and the second open end of the tubing member is sealed (tipped) to define the finished envelope. Use of the disk substantially eliminates the possibility of shred migration into the second open end region during sealing thereof, thus assuring a positive seal at the envelope's tip portion.

6 Claims, 7 Drawing Figures

FIG.2
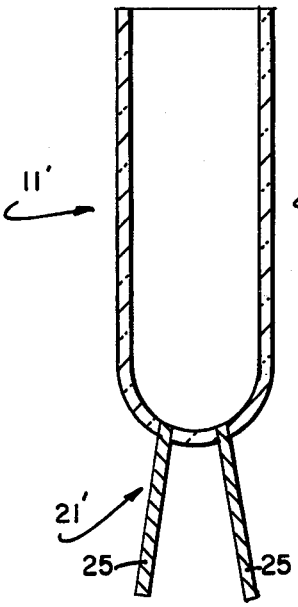
FIG.3
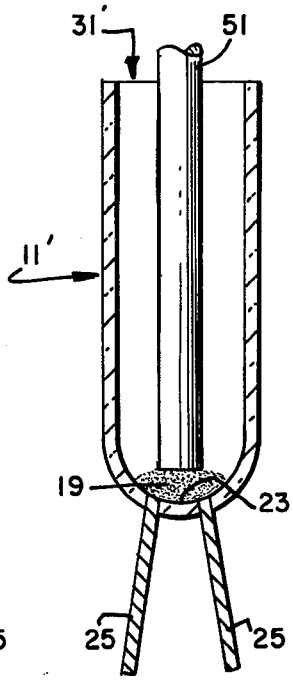
FIG.4
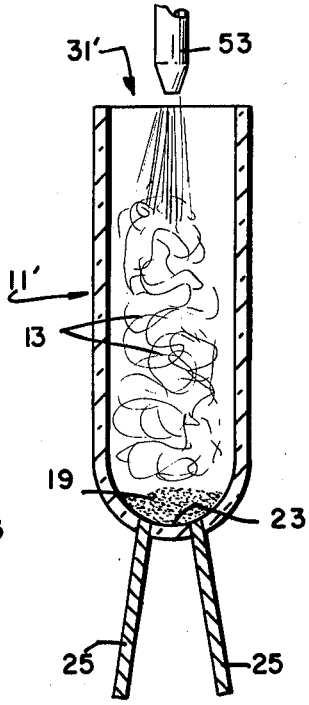
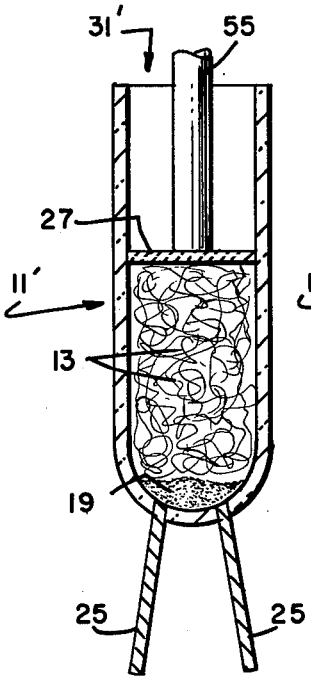
FIG.5
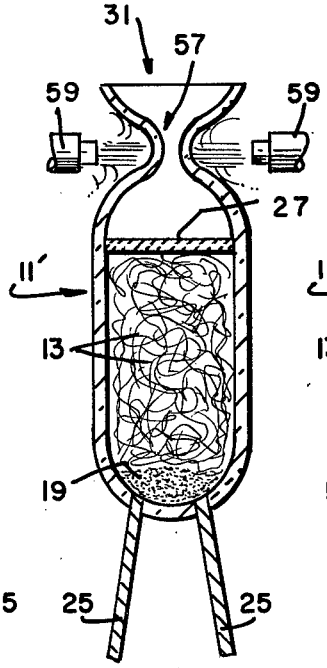
FIG.6
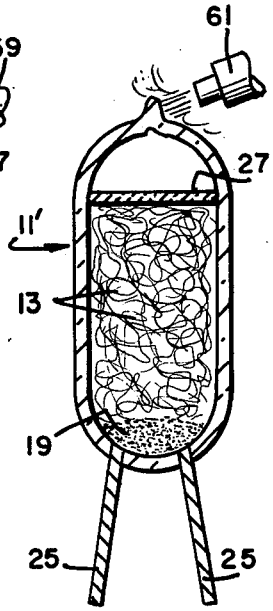
FIG.7

METHOD OF MAKING PHOTOFLASH LAMP TO PREVENT SHRED MIGRATION INTO TIP PORTION OF LAMP ENVELOPE DURING SEALING THEREOF

DESCRIPTION

1. Technical Field

The present invention relates to photoflash lamps and particularly to photoflash lamps which are electrically activated. Even more particularly, the invention relates to methods of making such lamps.

2. Background

Lamps of the above type are generally classified into two varieties: low-voltage and high-voltage. Low-voltage photoflash lamps typically include a glass envelope with a combustion-supporting gas (e.g., oxygen) and a quantity of filamentary, combustible material (e.g., shredded hafnium and zirconium) therein. A pair of electrically conductive lead wires are usually sealed in one end of the envelope and extend therein. A filament is utilized and interconnects the extending ends of the wires. When the filament is heated by a firing current usually generated from a low-voltage source such as battery or charged capacitor (e.g., having a voltage of from about 1.5 to 15 volts), it ignites a primer material which then ignites the combustible material to produce a flash of light. Naturally, the oxygen gas aids in the above ignition. In high-voltage lamps, the use of a filament is usually excluded by the provision of a glass or ceramic bead in which are located the extending ends of the lamp's conducting wires. The combustible-igniting primer material serves to bridge the portions of these ends which project through the bead. High-voltage lamps also include the aforedescribed filamentary material and combustion-supporting gas. Flashing is accomplished by a firing pulse approaching a few thousand volts and usually provided by a piezolectric element. In another type of high-voltage lamp, the primer is located within an indentation in the bottom of the lamp and the conductive wires extend therein.

The teachings of the instant invention are particularly concerned with methods of making high voltage lamps, although it will be understood from the followng that said teachings may be readily extended to lamps of the earlier generation, low voltage variety. Even more particularly, the teachings as provided herein are especially concerned with high voltage lamps wherein the primer material is to be located in the bottom of the lamp (e.g., along a bottom surface thereof. Locating the lamp's primer material within a recess, cavity, indentation, etc. at the bottom end (that containing the lamp's two lead-in wires) of the envelope is particularly desirable in photoflash lamps of the subminiature variety (e.g., those having an internal volume of less than about 0.2 cubic centimeters) in view of the relatively large space required by the lead-in wires which form part of the lamp's ignition structure (the primer material typically forming the remaining part).

One particular problem with producing lamps of the above variety is the ready tendency for the shredded combustible material (e.g., zirconium or hafnium foil) to migrate upwardly and become trapped (or sealed) within the tip portion of the finished lamp's envelope during final sealing thereof. As a result of this occurrence, improper seals were often formed, causing the lamp's atmosphere (e.g., oxygen) to leak and the lamp to eventually be rendered inoperative. Such migration typically occurred during the "necking" operation used to produce a restriction in the glass tubing immediately prior to final sealing or tipping. This is believed due, in part at least, the tendency of the cold worked zirconium to stress relieve itself during the high temperatures caused by the "necking" flames (e.g., oxygen burners).

The present invention, as will be defined, describes a new and unique method of making a photoflash lamp that substantantially eliminates the possibility of a defectively sealed lamp envelope as a result of adverse combustible shred migration into the lamp envelopes's tip portion. Although the teachings as provided herein re particularly adaptable to photoflash lamps of the electrically-activated, subminiature variety, it is understood that these teachings are also applicable to other varieties of high voltage photoflash lamps, including those containing the aforementioned ignition structure wherein a glass support bead or similar component is also used.

It is believed, therefore, that a method of making a photoflash lamp in the manner defined herein would constitute a significant advancement in the art.

DISCLOSURE OF THE INVENTION

It is a primary object of the present invention to provide a new and unique method of making an electrically-activated photoflash lamp wherein shred migration into the lamp envelope's tip (end) portion is substantially eliminated, thus, assuring a finished product wherein the envelope is positively sealed.

It is another object of the present invention to provide a method of making a photoflash lamp which can be readily achieved on a mass production basis and therefore at relatively low cost.

In accordance with one aspect of the invention, there is provided a method of making a photoflash lamp, said method comprising providing an elongated, light-transmitting glass tubular member having opposing open ends, sealing a first open end of said glass tubular member, said sealed first end including a pair of lead-in wires secured therein each having an end portion having access to the interior of said tubular member, positioning a quantity of primer material within said tubular member through an opposing, second open end thereof, said quantity of primer material electrically connected to said end portions of said lead-in wires, positioning a predetermined quantity of combustible, light-producing shred material within said tubular member through said opposing, second open end thereof, positioning a thin member within said tubular member through said opposing, second open end thereof, said thin member being positioned within said tubular member such that migration of said combustible shred material is prevented during subsequent sealing of the tubular member, and thereafter sealing said second end of said tubular member above said thin member to define an envelope.

BRIEF DESCRIPTION OF THE DRAWINGS

FIGS. 2–7 represent the various steps of producing the lamp in FIG. 1 in accordance with a preferred embodiment of the invention.

BEST MODE FOR CARRYING OUT THE INVENTION

Figure 1:
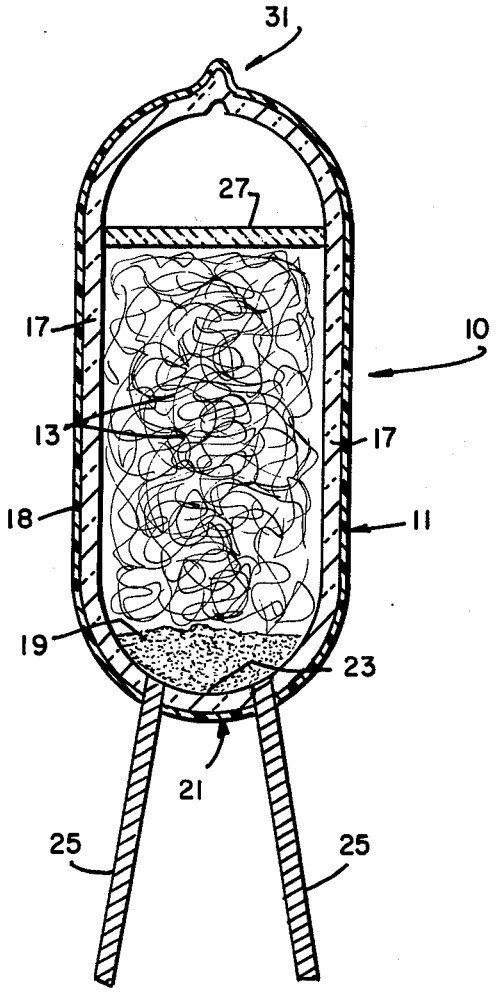
In FIG. 1, there is shown an electrically-activated photoflash lamp produced in accordance with the teachings of the instant invention.

For a better understanding of the present invention, together with other and further objects, advantages, and capabilities thereof, reference is made to the following disclosure and appended claims in connection with the above-described drawings.

With particular attention to FIG. 1, there is shown a photoflash lamp 10 produced in accordance with the teachings of the instant invention. Lamp 10 comprises an elongated, light-transmitting envelope 11, a quantity of combustible, light-producing shred material 13 positioned within the envelope, and an ignition means 15 for igniting the combustible 13. Envelope 11 is glass (e.g., lime glass). By the term light-transmitting is meant any glass material which permits passage of the high intensity light typically provided frm a photoflash lamp therethrough without substantially altering said output. Envelope 11, in cross-section, is preferably of substantially cylindrical configuration having an external diameter of about 0.200 inch. Each of the longitudinal side walls 17 of the envelope possess a thickness of about 0.025 inch. The total internal volume of envelope 11 is somewhat less than about 0.200 cubic centimeter, specifically, about 0.175 cubic centimeter. In one specific example, the finished envelope (as shown in FIG. 1) possessed a total length of about 0.650 inch, or about three times the envelope's external diameter.

Lamp 10 also includes a protective, light-transmitting coating 18 about envelope 11 to prevent escapement of particles of envelope material should the envelope be subjected to excessively high internal pressure during ignition thereof. Coating 18 is preferably cellulose acetate.

Combustible, light-producing material 13 is preferably zirconium or hafnium and, as stated, of shredded configuration. That is, material 13 is comprised of several individual shreds of the stated metal wherein these shreds are sheared from a sheet of thin foil. Use of shredded combustible material of the variety described is known in the art and further description is not believed necessary. In one example, a total of approximately 12 milligrams of zirconium shreds was utilized within the lamp vessel. Anywhere from 3 to 15 milligrams may be used in envelopes of the volumes defined herein.

Ignition means 15 comprises a quantity of primer material 19 located within a first, bottom end 21 of envelope 11. As shown, primer material 19 is positioned along the bottom wall 23 of end 21. In one example, a total of from about 0.500 to about 0.750 milligrams of primer was used. Primer material 19 comprises a mixture of about 80 percent by weight zirconium and about 20 percent by weight potassium perchlorate. It is to be understood, however, that other materials such as are known in the art may be utilized. It is also possible to modify the percentages of those materials as defined, without adversely affecting the performance of lamp 10. As further shown in FIG. 1, ignition means 15 also includes a pair of lead-in wires 25 which are secured within the bottom end of envelope 11 in electrical contact with the primer 19. Sealing of each of the lead-in wires 25 is accomplished in the manner defined below and further description is therefore not believed necessary. Each wire 25 is preferably of a nickel-iron alloy and possesses an external diameter of about 0.015 inch. Wires 25 are spaced apart within the bottom end 21 of envelope 11 a total distance of about 0.040 inch. Application of a suitable pulse (such as a high voltage, low energy pulse provided by a piezoelectric element typically utilized in many of today's pocket-type cameras) results in generation of a spark between the ends of each wire which are in contact with primer 19. Passage of this spark through the primer 19 results in ignition thereof to in turn ignite the shredded combustible material 13 located immediately adjacent thereto. As shown, the end portions of lead-in wires 25 which contact primer material 19 are flush with interior surface 23.

Located within a second, opposing end of envelope 11 is a thin member 27, said member being positioned within the glass tubing member which eventually forms envelope 11 in accordance with the teachings of the instant invention.

The thin member 27 used in lamp 10 comprises a substantially cylindrical 0.002 inch thick mica disk having an external diameter slightly greater than the corresponding internal diameter of the glass tubing member forming envelope 11. Because this diameter is slightly larger and in view of the ability of the mica to flex, the disk frictionally engages the glass tubing during insertion therein. The disk is also prevented from being upwardly displaced when in its final position (FIG. 1) by the tipped end portion 31 of envelope 11. In one example, disk 27 had an external diameter of 0.160 inch, or about 0.010 inch greater than the internal diameter of the finished envelope. In producing lamp 10 (in the manner shown in FIGS. 2–7), it is understood that the tipped end 31 is achieved subsequent to insertion of disk 27 within the open second end of the glass tubing which eventually constitutes envelope 11. Primer 19 and shredded combustible 13 are previously positioned within this open end, said positioning occuring after the aforementioned sealing of the two lead-in wires 25 within first end 21. Tipping of the glass tubing to provide end 31 (FIG. 8) can be accomplished using techiniques known in the photoflash lamp art. One distinct advantage of the method taught herein is that utilization of disk 27 substantially eliminates the possibility of combustible shred material being captured within tip portion 31 during sealing thereof, a common occurrence when tip-sealing subminiature lamp envelopes of the type defined herein. Shred material within the second end can adversely affect the seal formed thereat, as stated above. Understandably, positioning of disk 27 prior to forming the second sealing operation forces substantially all of the shred material downwardly within envelope 11, thus preventing the above undesirable occurrence. Another distinct feature of the invention is that disk 27 prevents droplets of molten zirconium from contacting the domed, second end of envelope 11 should lamp 10 be fired while in an inverted (tip down) mode.

It is also possible to utilize a material other than mica for disk 27. For example, it is possible to use an aluminum disk with equal success, said disk possessing substantially the same configuration and dimensions described above. It is also possible to provide a disk of a different configuration that stated, with suitable examples being either square or rectangular. A cylindrical configuration is preferred when a corresponding cylindrical-shaped glass envelope is employed. It is even further possible to loosely position the disk within envelope 11, thus allowing this component to rest atop combustible 13. Frictional insertion and retention is preferred, however, to assure optimum containment of combustible shreds.

In FIGS. 2–7, there are shown the various steps of producing photoflash lamp 10 in accordance with a preferred embodiment of the instant invention. In FIG. 2, an elongated, light-transmitting glass tubular member is provided and sealed at a first end 21' thereof. In its original form, the tubular member (11') is of cylindrical configuration and contains opposing open ends (the first open end being shown as now sealed in FIG. 2). It is understood that elongated tubing member 11' is to eventually comprise the finished envelope (11) of lamp 10 and is therefore of the material described above (e.g., lime glass). The first open end of tubing member 11' is sealed to secure the lead-in wires 25 therein. The preferred method of sealing this end is defined in U.S. Pat. No. 4,369,556, entitled "Method of Making a Photoflash Lamp Having New Lead Seal Structure" (Inventors: A. C. Bouchard et al). U.S. Pat. No. 4,369,556 was filed July 21, 1980, and is assigned to the same assignee as the instant invention. Specifically, heat is applied to the first open end of the glass tubing member while in the inverted state (first end up) such that the glass will flow about and capture the end portions of the downwardly projecting lead-in wires 25 to provide securement thereof. It is understood with regard to the invention that other methods of sealing the first end and securing lead-in wires 25 can be utilized, including the well known step of press-sealing.

In FIG. 3, the aforedefined quantity of primer material 19 is inserted within tubing member 11' through the opposing, second open end 31' thereof. Primer 19 is originally disposed on a suitable transfer device such as a 0.0625 inch diameter steel rod 51. The primer is initially deposited on the bottom surface 23 of tubing member 11' in wet (liquid) form and the steel rod 51 removed. It is thus seen that because the extreme end portions of each lead-in wire 25 has access to the internal region of tubing member 11', the deposited primer material 19 is able to physically contact said extreme ends and thus be in electrical connection therewith upon drying. The primer material is then dried by subjecting tubing member 11' to an elevated temperature of about 60 degrees Celsius for about 15 minutes.

With primer 19 dried, the aforementioned quantity of combustible material 13 is air blown within the open end 31'. A preferred technique for doing this is to use an air flow at a pressure of about three atmospheres, said techinque described in U.S. Pat. No. 3,630,650 (P. Kaufmann et al). In FIG. 4, the member represented by the numeral 53 comprises the air nozzle utilized to direct air in the direction indicated.

In FIG. 5, thin member 27 is inserted within the second, open end 31'. The preferred transfer device for inserting mica disk 27 is a vacuum tweezer, model EVG-100, available from the AIR-VAC Engineering Company, P.O. Box 522, Milford, Conn. 06461. This mechanism, represented by the numeral 55, is readily adaptable to mass production equipment as is the steel transfer rod 51 (FIG. 3), thus rendering the instant invention ideally suited for mass production and the distinct cost advantages associated therewith.

In FIG. 6, a restriction 57 is provided in the vicinity of open end 31' immediately above the mica disk 27. A pair of opposed natural gas-oxygen or air burners 59 is utilized to provide this narrowed restrictive portion in tubing member 11'. As already stated, use of mica disk 27 prevents the possibility of combustible shred material from being located within this narrowed, restrictive portion of tubing member 11' immediately prior to providing a seal at the second end thereof. Accordingly, shreds are thus prevented from being sealed within the glass at this end, thereby assuring an effective seal. It is also seen that use of disk 27 aids in compaction of combustible 13.

Tipping (or sealing) of the second open end of tubing member 11' is accomplished by a technique known in the art (e.g., one using an oxygen flame burner 61) and further description is therefore not believed necessary. Immediately prior to tipping of tubing member 11' to define the final configuration for the lamp's envelope, it is preferred to introduce a combustion supporting atmosphere such as oxygen within the tubing member through the remaining open end thereof. In one example of the invention, the oxygen was established at a pressure of from about 6 to 8 atmospheres within the formed envelope. This technique is also known in the art and further description is not provided. Surprisingly, outgassing of the envelope and introduction of the defined atmosphere did not alter the dimensional integrity of disk 27. After forming of the completed envelope, the envelope is covered with a protective, light-transmitting coating (18 in FIG. 1). A preferred material for coating 18 is cellulose acetate. This material is applied using a technique known in the art (e.g., by dipping the envelope within a contaniner of liquid solution, or using vacuum-forming of the material in solid form).

While there have been shown and described what are at present considered the preferred embodiments of the invention, it will be obvious to those skilled in the art that various changes and modifications may be made therein without departing from the scope of the invention as defined by the appended claims.

I claim:

1. A method of making a photoflash lamp, said method comprising:

providing an elongated, light-transmitting glass tubular member having opposing open ends;

sealing a first open end of said glass tubular member, said sealed first end including a pair of lead-in wires secured therein each having an end portion having access to the interior of said tubular member;

positioning a quantity of primer material within said tubular member through an opposing, second open end thereof, said quantity of primer material electrically connected to said end portions of said lead-in wires;

positioning a predetermined quantity of combustible, light-producing material within said tubular member through said opposing, second open end thereof;

frictionally positioning a thin member having an external configuration substantially similar to the internal configuration of said tubular member within said tubular member through said opposing, second open end thereof, said thin member engaging said combustible, light-producing shred material to prevent migration of said material toward said opposing, second open end of said glass tubular member;

introducing a combustion-supporting gas within said tubular member through said opposing, second open end; and thereafter sealing said second end of said tubular member above said thin member to define an envelope.

2. The method according to claim 1 further including positioning said quantity of primer material on an internal surface of said first, sealed end portion of said tubular member in liquid form and thereafter drying said first quantity prior to said positioning of said combustible material.

3. The method according to claim 1 further including providing a restriction within said tubular member in the vicinity of said opposing, second open end prior to said introduction of said combustion-supporting gas, said restriction being located immediately above said thin member.

4. The method according to claim 1 further including the step of providing a protective, light-transmitting coating on the external surface of said defined envelope.

5. The method according to claim 1 wherein said thin member is positioned in said engagement with said combustible material using a vacuum mechanism.

6. The method according to claim 1 wherein said external configuration of said thin member and said internal configuration of said tubular member are both substantially cylindrical.

* * * * *